US005963180A

United States Patent [19]

Leisten

[11] Patent Number: 5,963,180

[45] Date of Patent: Oct. 5, 1999

[54] ANTENNA SYSTEM FOR RADIO SIGNALS IN AT LEAST TWO SPACED-APART FREQUENCY BANDS

[75] Inventor: Oliver Paul Leisten, Duston, United Kingdom

[73] Assignee: Symmetricom, Inc., San Jose, Calif.

[21] Appl. No.: 08/690,843

[22] Filed: Aug. 1, 1996

[30] Foreign Application Priority Data

Mar. 29, 1996 [GB] United Kingdom ..... 9606593

[51] Int. Cl.[6] ..... H01Q 1/36

[52] U.S. Cl. ..... 343/895; 343/702; 333/126

[58] Field of Search ..... 343/895, 821; 333/126, 134; 455/82, 83; 370/37, 295, 297, 281

[56] References Cited

U.S. PATENT DOCUMENTS

| | | | |
|---|---|---|---|
| 3,611,198 | 10/1971 | Ma | 333/6 |
| 3,633,210 | 1/1972 | Westerman | 343/895 |
| 4,148,030 | 4/1979 | Foldes | 343/895 |
| 4,168,479 | 9/1979 | Rubin | 333/126 |
| 4,706,049 | 11/1987 | Dydyk | 333/110 |
| 4,902,992 | 2/1990 | Rubin et al. | 333/126 |
| 4,910,481 | 3/1990 | Sasaki et al. | 333/134 |
| 4,940,992 | 7/1990 | Nguyen et al. | 343/803 |
| 5,019,829 | 5/1991 | Heckman et al. | 343/700 MS |
| 5,023,866 | 6/1991 | De Muro | 333/134 |
| 5,170,493 | 12/1992 | Roth | 455/82 |
| 5,255,005 | 10/1993 | Terret et al. | 343/895 |
| 5,258,728 | 11/1993 | Taniyoshi et al. | 333/132 |
| 5,281,934 | 1/1994 | Shiau et al. | 333/134 |
| 5,341,149 | 8/1994 | Valimaa et al. | 343/895 |
| 5,349,361 | 9/1994 | Egashira et al. | 343/715 |
| 5,349,365 | 9/1994 | Ow et al. | 343/895 |
| 5,406,296 | 4/1995 | Egashira et al. | 343/715 |
| 5,406,693 | 4/1995 | Egashira et al. | 29/600 |
| 5,479,180 | 12/1995 | Lenzing et al. | 343/895 |
| 5,548,255 | 8/1996 | Spielman | 333/132 |

FOREIGN PATENT DOCUMENTS

| | | | |
|---|---|---|---|
| 0429255 | 11/1990 | European Pat. Off. . | |
| 2 570 546 | 3/1986 | France | H01Q 1/36 |
| 95249973 | 6/1995 | Japan . | |
| 2 292 257 | 2/1996 | United Kingdom | H01Q 11/08 |
| 2292638 | 2/1996 | United Kingdom . | |
| WO 96/06468 | 2/1996 | WIPO | H01Q 11/08 |

OTHER PUBLICATIONS

Espaignol, J. et al., "Duplexeur A Resonateurs Dielectriques En Bande K", 6es Journees Nationales Microondes, Montpellier, Jun. 21–23, 1989, Centre D'Electronique De Montpellier, pp. 321–322.

*Primary Examiner*—Don Wong
*Assistant Examiner*—Tan Ho
*Attorney, Agent, or Firm*—Wilson Sonsini Goodrich & Rosati

[57] ABSTRACT

In an antenna system for radio signals in at least two spaced-apart frequency bands above 200 MHz, a quadrifilar helical antenna having an elongate dielectric core with a relative dielectric constant greater than 5 has a conductive sleeve surrounding a proximal part of the core and a longitudinal feeder structure extending through the core to a connection with the helical antenna elements at a distal end of the core. The antenna is operated in an upper frequency band in which it exhibits a first mode of resonance characterized by current maxima at the connections of the helical elements to the feeder structure and at their junctions with the rim of the sleeve, and in a lower frequency band in which the antenna exhibits a second mode of resonance characterized by current minima in the region of the junctions of the helical elements and the sleeve rim. To permit dual mode operation, the antenna system includes an impedance-matching diplexer having filters coupled between a common port for the antenna and further ports for connection to radio signal processing equipment such as a GPS receiver and a mobile telephone operating in the two frequency bands. In the preferred embodiment, the filters and impedance matching elements are formed as microstrip elements on a single substrate.

39 Claims, 4 Drawing Sheets

ANTENNA SYSTEM FOR RADIO SIGNALS IN AT LEAST TWO SPACED-APART FREQUENCY BANDS

FIELD OF THE INVENTION

This invention relates to an antenna system including an antenna with an elongate dielectric core, elongate conductive elements on or adjacent an outer surface of a distal part of the core, and a conductive sleeve surrounding a proximal part of the core. The invention also relates to a novel use of such an antenna.

BACKGROUND OF THE INVENTION

An antenna of the above description is disclosed in the Applicant's co-pending British Patent Application which has been published under the number 2292638A, the subject matter of which is incorporated in this specification by reference. In its preferred form, the antenna of that application has a cylindrical ceramic core, the volume of the solid ceramic material of the core occupying at least 50% of the internal volume of the envelope defined by the elongate conductive elements and the sleeve, with the elements lying on an outer cylindrical surface of the core.

The antenna is particularly intended for the reception of circularly polarised signals from sources which may be directly above the antenna, i.e on its axis, or at a location a few degrees above a plane perpendicular to the antenna axis and passing through the antenna, or from sources located anywhere in the solid angle between these extremes. Such signals include the signals transmitted by satellites of a satellite navigation system such as GPS (Global Positioning System). To receive such signals, the elongate conductive elements comprise four coextensive helical elements having a common central axis which is the axis of the core, the elements being arranged as two laterally opposed pairs of elements, with the elements of one pair having a longer electrical length than the elements of the other pair. Such an antenna has advantages over air-cored antennas of robustness and small size, and over patch antennas of relatively uniform gain over the solid angle within which transmitting satellite sources are positioned.

SUMMARY OF THE INVENTION

The applicants have found that it is possible to use such an antenna in different, spaced apart, frequency bands. Accordingly, the invention provides an antenna system comprising an antenna having an elongate dielectric core with a relative dielectric constant greater than 5, at least one pair of elongate conductive elements located in a longitudinal by coextensive and laterally opposed relationship on or adjacent an outer surface of a distal part of the core, a conductive sleeve surrounding a proximal part of the core, and a longitudinal feeder structure extending through the core, the elongate conductive elements extending between distal connections to the feeder structure and a distal rim of the sleeve. Connected to the antenna is an impedance matching diplexer which has filters coupled between a common port connected to a proximal end of the antenna feeder structure, and respective further ports for connection to radio signal processing equipment operating in the two frequency bands. The filters comprise a first filter tuned to an upper frequency which lies in one of the bands and at which the antenna is resonant in a first mode of resonance, and a second filter tuned to a lower frequency which lies in the other band and at which the antenna is resonant in a second mode of resonance. The first mode of resonance may be associated with substantially balanced feed current at the distal end of the feed structure, e.g. when the sleeve acts as a trap isolating the elongate conductive elements from a ground connection at the proximal end of the antenna, the or each pair of elongate conductive elements acting as a loop, with currents travelling around the rim of the sleeve between opposing elements of the pair. In the case of the antenna having two or more pairs of helical elements forming part of loops of differing electrical lengths, such balanced operation may typically be associated with circularly polarised signals directed within a solid angle centred on a common central axis of the helical elements. In this first mode, the antenna may exhibit current maxima at the connections of the elongate conductive elements to the feeder structure and at their junction with the rim of the sleeve.

The second mode of resonance is preferably associated with single-ended or unbalanced feed currents at the distal end of the feeder structure, with the conductive sleeve forming part of the radiating structure, as is typically the case when the antenna is resonant in a monopole mode for receiving or transmitting linearly polarised signals, especially signals polarised in the direction of a central axis of the antenna. Such a mode of resonance may be characterised by current minima in the region of the junction of the elongate elements and the rim of the sleeve.

In the first mode of resonance, the frequency of resonance is typically a function of the electrical lengths of the elongate elements, whilst the resonant frequency of the second mode of resonance is a function of the sum of (a) the electrical lengths of the elongate elements and (b) the electrical length of the sleeve. In the general case, the electrical lengths of the elongate conductive elements are such as to produce an average transmission delay of, at least approximately, 180° at a resonant frequency associated with the first mode of resonance. The frequency of the second mode of resonance may be determined by the sum of the average electrical length of the elongate conductive elements and the average electrical length of the sleeve in the longitudinal direction corresponding to a transmission delay of at least approximately 180° at that frequency.

In the preferred embodiment of the antenna system, the diplexer comprises an impedance transforming element coupled between the common port and a node to which the filters and an impedance compensation stub are connected. The transforming element, the filters, and the stub are conveniently formed as microstrip components. In such a construction, the transforming element may comprise a conductive strip on an insulative substrate plate covered on its opposite face with a conductive ground layer. The strip forms, in conjunction with the ground layer, a transmission line of predetermined characteristic impedance. Similarly, the stub may be formed as a conductive strip having an open circuit end. Although the filters may be conventional "engine block" filters, they may instead be formed of microstrip elements on the same substrate as the transforming element and the stub. These filters are desirably connected to the above-mentioned node by conductors which are electrically short in comparison to the electrical lengths of the transforming element.

The transforming element may also comprise a length of cable connected in series between the antenna feeder structure and the diplexer node, or it may comprise the series combination of such a cable and a length of microstrip between the feeder structure and the node, the cable having a characteristic impedance between the source impedance constituted by the antenna and a selected load impedance for the node.

The antenna system typically operates over two frequency bands only, but it is possible within the scope of the invention to provide a system operative in more than three spaced apart bands the antenna having a corresponding number of resonance modes.

According to a second aspect of the invention, there is provided a radio communication system comprising an antenna system as described above, a satellite positioning or timing receiver (e.g. a GPS receiver) connected to one of the further ports of the diplexer, and a cellular or mobile telephone connected to another of the further ports of the diplexer. The antenna and the filters are configured such that resonant frequencies associated with the different modes of resonance of the antenna lie respectively in the operating band of the receiver and the operating band of the telephone.

The diplexer is also the subject of a third aspect of the invention which provides a diplexer for operation at frequencies in excess of 200 MHz comprising: an antenna port; an impedance transformer in the form of a length of transmission line having one end coupled to the antenna port and the other end forming a circuit node; first and second equipment ports; a first bandpass filter tuned to one frequency and connected between the node and the first equipment port, a second bandpass filter tuned to another frequency and connected between the node and the second equipment port; and a reactance compensating element connected to the node.

The length of the transmission line forming the impedance transformer may be such as to effect a resistive impedance transformation at a frequency between the upper and the lower frequency whereby the impedances at the said node due to the transformer at the two frequencies has, respectively, a capacitive reactance component and an inductive reactance component, and wherein the stub length is such as to yield inductive and capacitive reactances respectively at the two frequencies thereby at least partly compensating for the capacitive and inductive reactances due to the transformer so as to yield at the node a resultant impedance at each of the two frequencies which is more nearly resistive than the impedances due to the transmission line.

Typically, the transmission line length is such as to provide a transmission delay of about 90° at a frequency at least approximately midway between the upper and lower frequencies.

The invention also provides, in accordance with a fourth aspect thereof, a novel use of an antenna comprising an elongate dielectric core with a relative dielectric constant greater than 5, at least one pair of elongate conductive elements located in a longitudinally coextensive and laterally opposed relationship on or adjacent an outer surface of a distal part of the core, a conductive sleeve surrounding a proximal part of the core, and a longitudinal feeder structure extending through the core, the said elongate conductive elements extending between distal connections to the feeder structure and a distal rim of the sleeve, wherein the novel use consists of operating the antenna in at least two spaced apart frequency bands, one of the bands containing a frequency at which the antenna exhibits a first mode of resonance, and another of the bands containing a frequency at which the antenna exhibits a second mode of resonance which is different from the first mode.

BRIEF DESCRIPTION OF THE DRAWINGS

Preferred embodiments of the present invention are described below by way of example with reference to the drawings.

In the drawings.

DETAILED DESCRIPTION OF THE PREFERRED EMBODIMENTS

Figure 1:
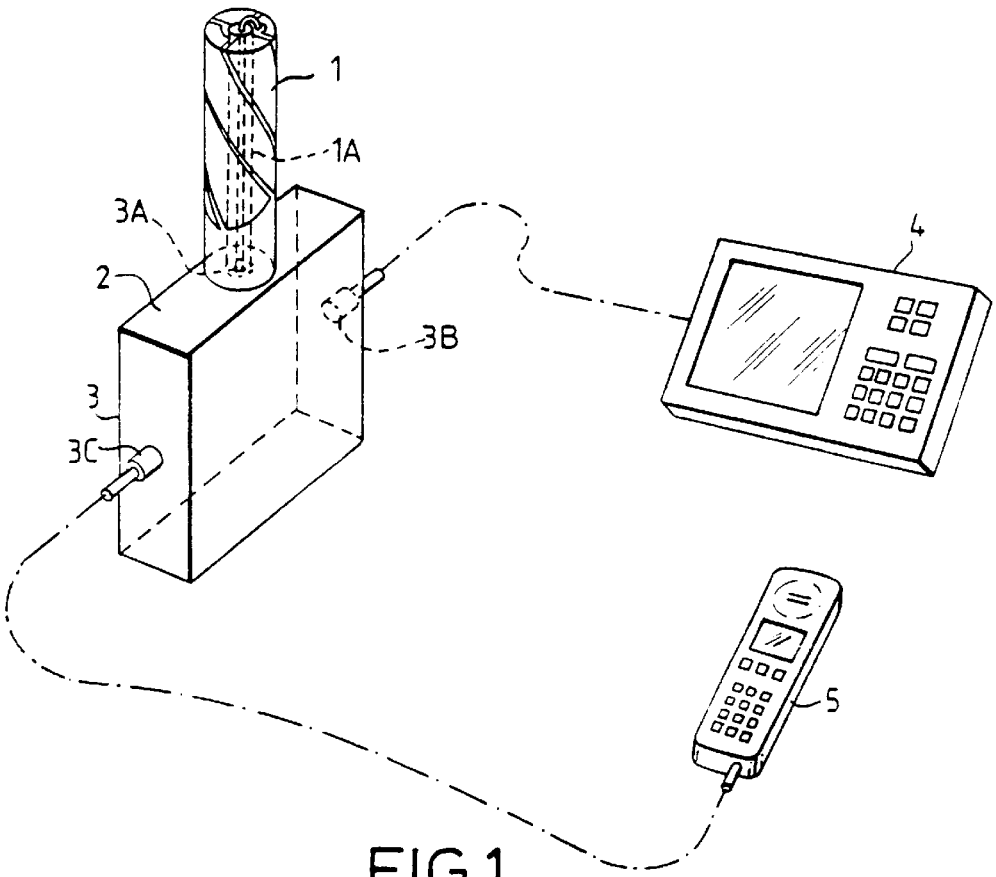
FIG. 1 is a diagram showing a radio communication system using an antenna system in accordance with the invention.

Referring to FIG. 1 of the drawings, a preferred antenna system in accordance with the invention for use at frequencies above 200 MHz may be used as part of radio communication equipment performing different functions. The antenna system comprises an antenna 1 in the form of an elongate cylindrical ceramic core with metallic elements plated on the outside to form a quadrifilar helical antenna with a proximal conductive sleeve forming a current trap between radiating elements of the antenna and a ground connection at its lower end. The antenna 1 is mounted on a laterally extending conductive surface 2 which, in this embodiment, is formed by a wall of the casing of a diplexer unit 3. An internal feeder structure 1A of the antenna is coupled to the diplexer unit 3 at a common port 3A thereof. The radio communication equipment includes a GPS receiver 5 connected to a first equipment port 3B of the diplexer unit 3 and a cellular telephone receiver 5 connected to a second equipment port 3C of the diplexer unit 3.

Antenna 1, as will be described below, has two modes of resonance in spaced apart frequency bands. In this example, the first mode of resonance is associated with a resonant frequency of 1.575 GHz, the antenna exhibiting a maximum in gain for circularly polarised signals at that frequency, the signals being directed generally vertically, i.e. parallel to the central axis of the antenna. This frequency is the GPS L1 frequency. The second mode of resonance of the antenna 1 in this embodiment is associated with a resonant frequency of about 860 MHz and signals linearly polarised in a direction parallel to the central axis of the antenna 1. 860 MHz is an example of a frequency lying in a cellular telephone band.

The diplexer unit 3 provides impedance matching of units 4 and 5 to the antenna 1 in its different modes of resonance, and isolates the two units 4 and 5 so that they may be operated independently, i.e. largely without the operation of one interfering with the operation of the other. The diplexer unit 3 will be described in more detail below.

The arrangement illustrated in FIG. 1 is suitable for a number of applications in which positioning information and the ability to communicate via a cellular telephone are required together. The arrangement is particularly useful for installation in an automobile, in which case the GPS receiver 4 can provide the driver with navigation information via the same antenna as a permanently installed car phone or a portable cellphone plugged into automobile wiring. The antenna 1 and diplexer unit 3, being small and robust, are particularly suited to automobile and other mobile applications. It is possible to combine the GPS receiver and the telephone within a single unit, together, if required, with the diplexer.

Figure 2:
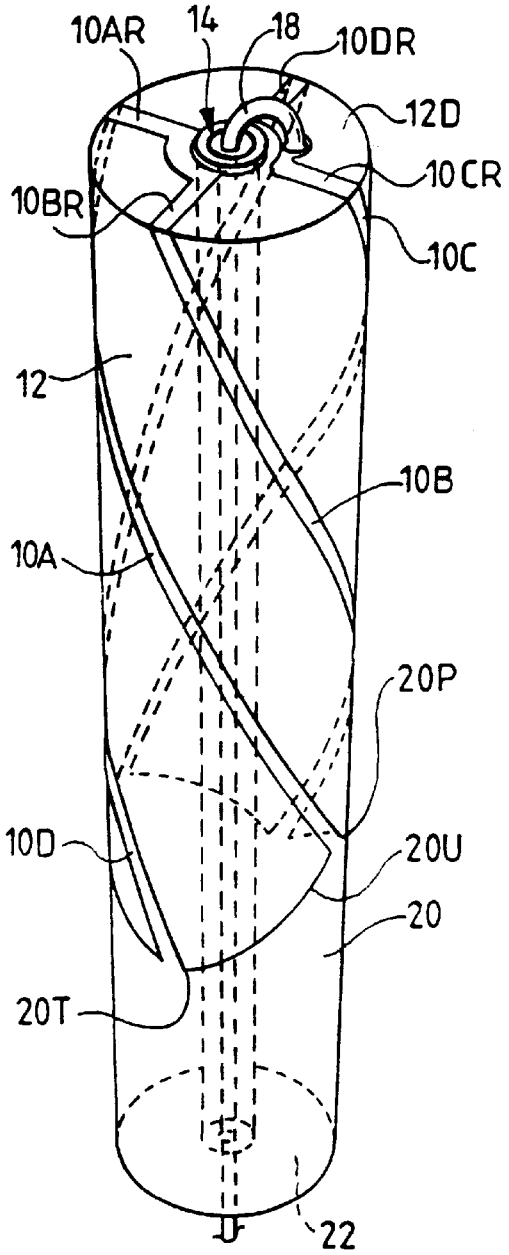
FIG. 2 is a perspective view of the antenna of the system of FIG. 1.
Figure 3:
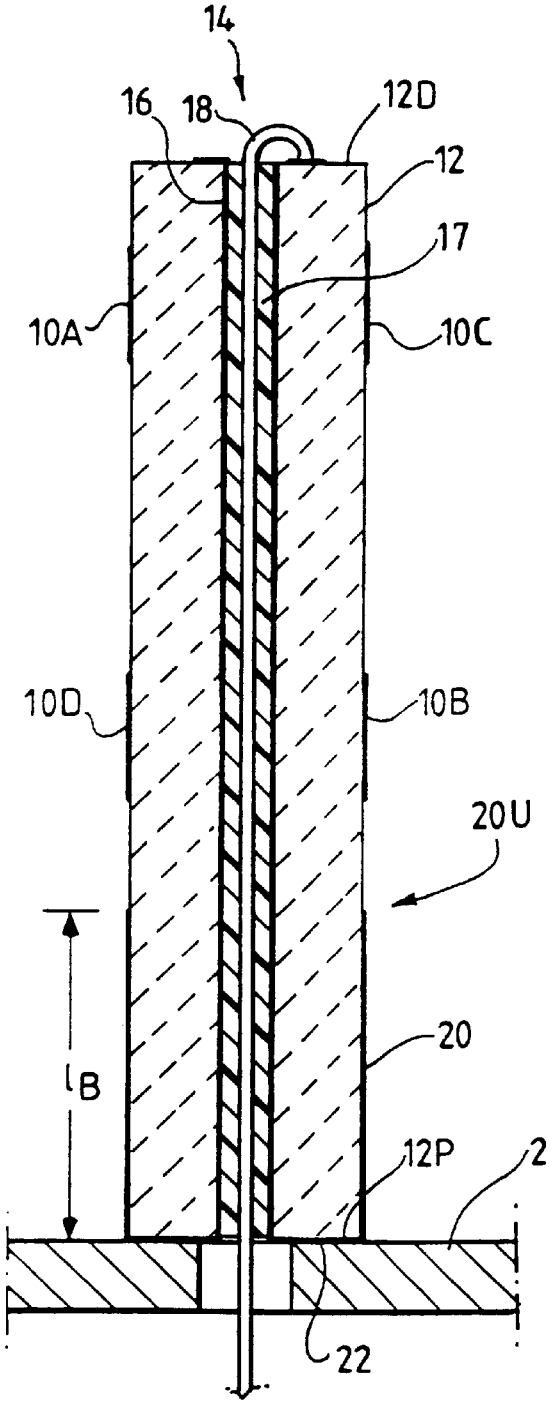
FIG. 3 is an axial cross-section of the antenna of FIG. 2, mounted on a conductive ground plane.

The antenna 1 is shown in more detail in FIGS. 2 and 3 and is as disclosed in Applicant's co-pending British Patent Application No. 9603914.4 the disclosure of which is incorporated in this specification by reference. In its preferred form, the antenna is quadrifilar having an antenna element structure with four longitudinally extending antenna elements 10A, 10B, 10C and 10D formed as metallic conductor tracks on the cylindrical outer surface of a ceramic core 12. The core has an axial passage 14 with an inner metallic lining 16, and the passage houses an axial feeder conductor 18. The inner conductor 18 and the lining 16 in this case form a feeder structure 1A for connecting a feed line to the antenna elements 10A–10D. The antenna element structure also includes corresponding radial antenna elements 10AR, 10BR, 10CR, 10DR formed as metallic tracks on a distal end face 12D of the core 12 connecting ends of the respective longitudinally extending elements 10A–10D to the feeder structure. The other ends of the antenna elements 10A–10D are connected to a common conductor in the form of a plated sleeve 20 surrounding a proximal end portion of the core 12. This sleeve 20 is in turn connected to the lining 16 of the axial passage 14 by plating 22 on the proximal end face 12P of the core 12. The material of the core 12 occupies the major portion of the interior volume defined by the antenna elements 10A–10D and the sleeve 20.

As will be seen from FIG. 2, the sleeve 20 has an irregular upper linking edge or rim 20U in that it rises and falls between peaks 20P and troughs 20T. The four longitudinally extending elements 10A–10D are of different lengths, two of the elements 10B, 10D being longer than the other two 10A, 10C by virtue of the longer elements being coupled to the sleeve 20 at the troughs of rim 20U while the other elements 10A, 10C are coupled to the peaks. In this embodiment, intended for reception of circularly polarised signals when resonant in a first mode of resonance, the longitudinally extending elements 10A–10C are simple helices, each executing a half turn around the axis of the core 12. The longer elements 10B, 10D have a longer helical pitch than the shorter elements 10A, 10C. Each pair of longitudinally extending and corresponding radial elements (for example 10A, 10AR) constitutes a conductor having a predetermined electrical length. In the present embodiment, it is arranged that the total length of each of the element pairs 10A, 10AR; 10C, 10CR having the shorter length corresponds to a transmission delay of approximately 135° at the operating wavelength in the first mode of resonance, whereas each of the element pairs 10B, 10BR; 10D, 10DR produce a longer delay, corresponding to substantially 225°. Thus, the average transmission delay is 180°, equivalent to an electrical length of $\lambda/2$ at the operating wavelength. The differing lengths produce the required phase shift conditions for a quadrifilar helix antenna for circularly polarised signals specified in Kilgus, "Resonant Quadrifilar Helix Design", The Microwave Journal, December 1970, pages 49–54. Two of the element pairs 10C, 10CR; 10D, 10DR (i.e. one long element pair and one short element pair) are connected at the inner ends of the radial elements 10CR, 10DR to the inner conductor 18 of the feeder structure at the distal end of the core 12, while the radial elements of the other two element pairs 10A, 10AR; 10B, 10BR are connected to the feeder screen formed by metallic lining 16. At the distal end of the feeder structure, the signals present on the inner conductor 18 and the feeder screen 16 are approximately balanced so that the antenna elements are connected to an approximately balanced source or load, as will be explained below.

With the left handed sense of the helical paths of the longitudinally extending elements 10A–10D, the antenna has its highest gain for right hand circularly polarised signals.

If the antenna is to be used instead for left hand circularly polarised signals, the direction of the helices is reversed and the pattern of connection of the radial elements is rotated through 90°. In the case of an antenna suitable for receiving both left hand and right hand circularly polarised signals, albeit with less gain, the longitudinally extending elements can be arranged to follow paths which are generally parallel to the axis.

As an alternative, the antenna may have helical elements of different lengths as above, but with the difference in lengths being obtained by meandering the longer elements about respective helical centre lines. In this case, the conductive sleeve is of constant axial length, as disclosed in the above-mentioned co-pending British Patent Application No. 2292638A.

The conductive sleeve 20 covers a proximal portion of the antenna core 12, thereby surrounding the feeder structure 16, 18, with the material of the core 12 filling the whole of the space between the sleeve 20 and the metallic lining 16 of the axial passage 14. The sleeve 20 forms a cylinder having an average axial length $l_B$ as show in FIG. 2 and is connected to the lining 16 by the plated layer 22 of the proximal end face 12P of the core 12. In the first mode of resonance, the combination of the sleeve 20 and plated layer 22 has the effect that signals in the transmission line formed by the feeder structure 16, 18 are converted between an unbalanced state at the proximal end of the antenna and an approximately balanced state at an axial position generally at the same axial distance from the proximal end as the average axial position of the upper linking edge 20U of the sleeve 20.

The preferred material for the core 12 is zirconium-titanate-based material. This material has the above-mentioned relative dielectric constant of 36 and is noted also for its dimensional and electrical stability with varying temperature. Dielectric loss is negligible. The core may be produced by extrusion or pressing.

The antenna elements 10A–10D, 10AR–10DR are metallic conductor tracks bonded to the outer cylindrical and end surfaces of the core 12, each track being of a width at least four times its thickness over its operative length. The tracks may be formed by initially plating the surfaces of the core 12 with a metallic layer and then selectively removing the layer to expose the core. Removal of the metallic layer may be performed by etching according to a pattern applied in a photographic layer similar to that used for etching printed circuit boards. Alternatively, the metallic material may be applied by selective deposition or by printing techniques. In all cases, the formation of the tracks as an integral layer on the outside of a dimensionally stable core leads to an antenna having dimensionally stable antenna elements.

The antenna is preferably directly mounted on a conductive surface such as provided by a sheet metal plate 24, as shown in FIG. 3, with the plated proximal end surface 12P electrically connected to the plate by, for example, soldering. In this embodiment metal plate 24 is part of the diplexer unit casing and the inner conductor 18 of the antenna for direct connection to a diplexer circuit as will be described below. The conductive lining 16 of the internal axial passage 14 of the antenna core is connected to the plated layer 22 of the proximal end face 12P of the antenna.

From FIGS. 2 and 3 it will be appreciated that the antenna is current-fed at its distal end. The amplitude of standing wave currents in the elements 10A–10D is at a maximum at the rim 20U of the sleeve 20 where they pass around the rim so that the two pairs of elements 10A, 10C and 10B, 10D form parts of two loops which are isolated from the grounded proximal end face 12P of the antenna. Standing wave voltage maxima exist approximately in the middle of the elements 10A–10D. In this mode of resonance, the radiation pattern of the antenna for right-hand circularly polarised signals is generally of cardioid form, directed distally and centred on the central axis of the core. In this quadrifilar mode, the antenna discriminates in the upward direction against left-hand polarisation, as mentioned above.

In this embodiment, the second mode of resonance is at a lower frequency and represents a mode which is quite different from the first mode of resonance. Again, the antenna is current-fed at the top, but standing wave currents decline to a minimum in the antenna elements 10A–10D in the region of the rim 20U of sleeve 20. The currents are relatively high on the inside surface of the sleeve 20, but here they do not affect the radiation pattern of the antenna. The antenna exhibits quarter wave resonance in a manner very similar to a conventional inverted monopole with a predominantly single-ended feed. There is little current flow around the rim 20U, which is consistent with the single-ended feed. In this mode, the antenna exhibits the classic toroidal pattern of a monopole antenna with signals which are linearly polarised parallel to the central axis of the core. There is strong discrimination against horizontal polarisation.

For an antenna capable of receiving GPS signals at 1.575 GHz and cellular telephone signals in the regions of 800 to 900 MHz, the length and diameter of the core 12 are typically in the region of 20 to 35 mm and 3 to 7 mm respectively, with the average axial extent of the sleeve 20 being in the region of from 8 mm to 16 mm. A particularly preferred antenna as shown in FIGS. 2 and 3 has a core length of approximately 28.25 mm and a diameter of approximately 5 mm, the average axial length of the sleeve 20 being about 12 mm. One surprising feature of the quadrifilar mode of resonance is that the performance in this mode is tolerant of substantial variation in the average axial length of the sleeve 20 from that corresponding to a transmission delay of 90° at the respective resonant frequency, to the extent that this length can be adjusted to obtain the required resonant frequency in the second mode of resonance. However, if it is necessary to vary the axial length of sleeve 20 so far from the quarter wavelength that performance of the antenna in the quadrifilar mode deteriorates to an unacceptable degree, it is possible to insert a choke in series between the sleeve 20 and the diplexer unit (specifically the conductive surface 2 (see FIG. 1)) to restore at least an approximately balanced current drive at the antenna distal face 12D.

The diplexer unit 3 of FIG. 1 contains a pair of filters, a reactance compensating stub and an impedance transforming element to match the antenna to both units 4 and 5 and to isolate the signals of one with respect to the signals of the other.

In an alternative arrangement the antenna may be mounted spaced from the diplexer unit 3 as will be described below with reference to the FIG. 6.

Figure 4:
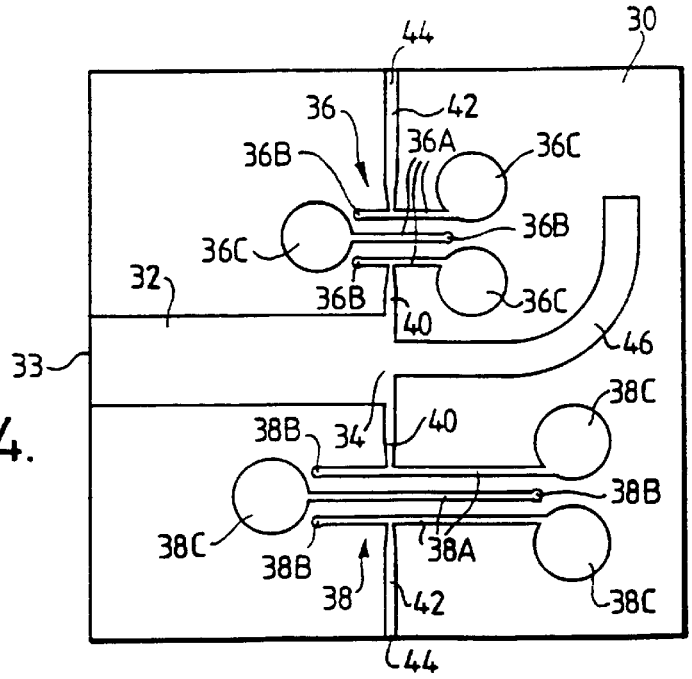
FIG. 4 is a plan view of a microstrip diplexer.

Referring to FIG. 4, the diplexer unit 3 of FIG. 1 has a screening casing (as shown in FIG. 1) enclosing a single insulative substrate plate 30 with a conductive ground layer on one side (the hidden side of plate 30 as viewed in FIG. 4), the other side of the plate bearing conductors as shown. These conductors comprise, firstly, an impedance transforming section 32 as a conductive strip forming a transmission line section extending between one end 33, which is connected to the antenna inner conductor, and the other end 34 which forms a circuit node. Secondly, connected to the node 34 are two bandpass filters 36, 38. Each is constituted by three inductively coupled parallel-resonant elements, with each element being formed of a narrow inductive strip 36A, 38A grounded at one end by a plated-through hole 36B, 38B and having a capacitor plate 36C, 38C at the opposite end, forming a capacitor with the ground conductor on the other surface of the substrate. In the case of each filter 36, 38, the inductive strip 36A, 38A nearest the node 34 is connected to the latter by an electrically short tapping conductor 40, which is tapered to effect a further impedance transformation. In each case, the inductive strip furthest from the node 34 is coupled to tapping lines 42 (which are also tapered near the filter) coupling the filter to respective equipment connections 44.

As will be apparent from the different sizes of filters 36, 38, they are tuned to different frequency bands, in fact the two bands corresponding to the two modes of resonance of the antenna 1.

Impedance matching at both resonant frequencies is achieved by the combination of the transforming section 32 and an open-circuit ended stub 46 extending from node 34 as shown in FIG. 4.

Transforming section 32 is dimensioned to have a characteristic transmission line impedance $Z_o$ given by:

$$Z_o=\sqrt{(Z_S Z_L)}$$

where $Z_S$ is the characteristic impedance of the antenna 1 at resonance, and $Z_L$ is a selected load impedance for the node 34 to suit filters 36 and 38. The length of the transforming section 32 is arranged to correspond to a transmission delay of about 90° at a frequency approximately midway between the two frequency bands corresponding to the first and second modes of resonance, in this case approximately 1.22 GHz. The effect of the transforming section 32 at different frequencies is illustrated by the Smith chart of FIG. 5A which represents the impedance seen at node 34 due to the transforming section 32 in the absence of the stub 46 over a range of frequencies from 0.1 to 1.6 GHz. Sections A and B of the curve indicate the two frequency bands centred on 860 MHz and 1.575 GHz, and it will be seen that a resistive impedance is obtained at the centre of the chart, at a frequency between the two bands, as mentioned above. The effect of stub 46 (see FIG. 4) is now considered with reference to the Smith chart of FIG. 5B. At low frequencies, the impedance presented solely by stub 46 at node 34 is relatively high, as is evident from the end of the curve in FIG. 5B being close to the right-hand side of the chart. With increasing frequency, the impedance passes around the perimeter of the chart through a zero impedance point corresponding to a frequency approximately midway between the frequency bands A and B due to the selected lengths of stub 46.

Figure 5A:
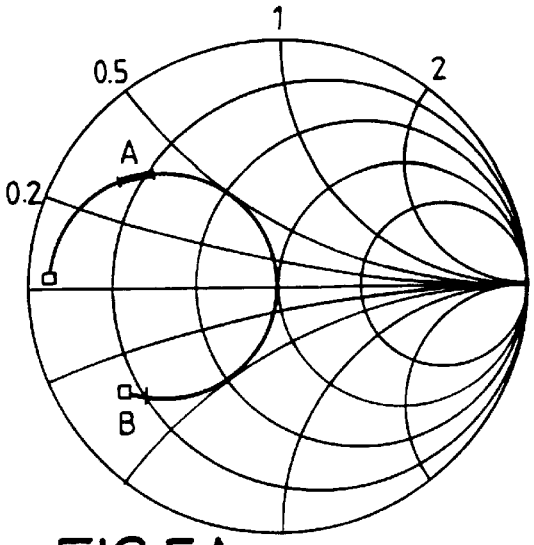
FIGS. 5A to 5E are Smith chart diagrams illustrating the functioning of the diplexer of FIG. 4.
Figure 5B:
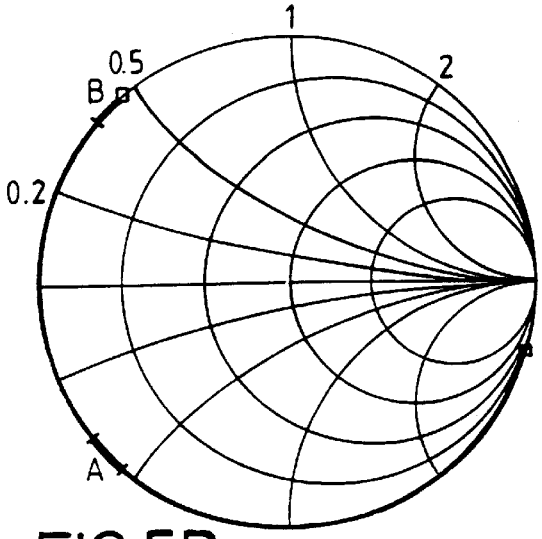

Comparing FIGS. 5A and 5B, it will be noted that the impedance at node 34 due to transforming section 32 in band A has an inductive reactance component, whilst the impedance in band B has a capacitive reactance component. In the Smith charts, the curves emanating from the right-hand end are lines of constant reactance. From FIG. 5B, it will be seen that the stub 46 is so dimensioned that the reactance component of the impedance presented solely by the stub 46 at node 34 in band A is capacitive and at least approximately equal to the inductive reactance in band A shown in FIG. 5A. Similarly, the impedance due to stub 46 in band B has an inductive reactance component which is at least approximately equal in magnitude to the capacitive reactance component in band B as shown in FIG. 5A.

Figure 5C:
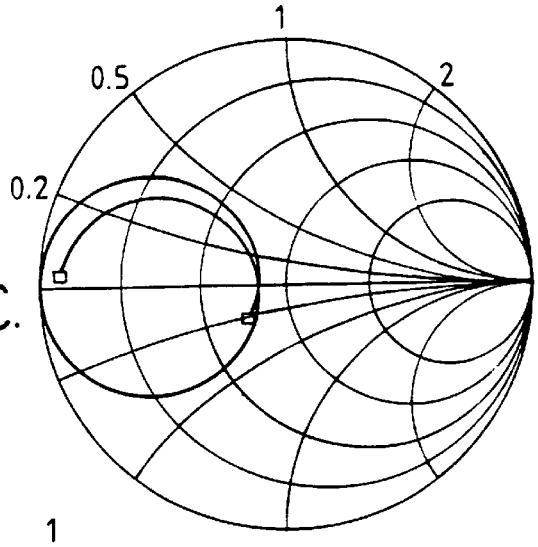
Figure 5D:
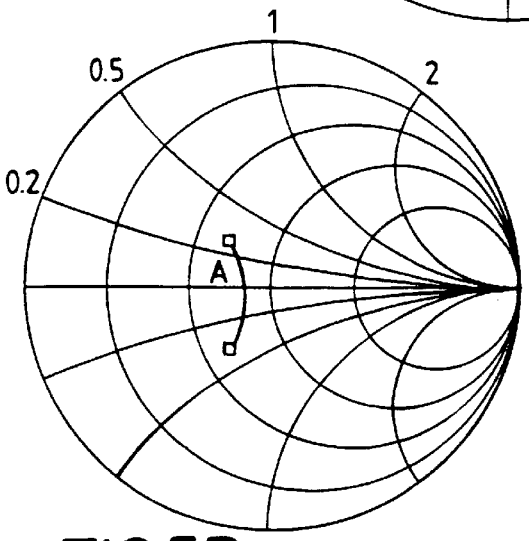
Figure 5E:
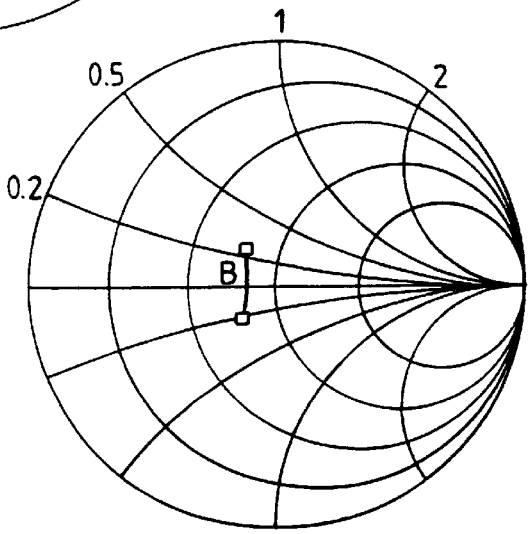

Referring now to FIG. 5C, the trace of the impedance at node 34 due to the combination of the transforming section 32 and the stub 46 follows a loop which begins, at low frequency, at an impedance corresponding to the source impedance at the port 3A indicated in FIG. 1. With increasing frequency, the trace follows a loop which crosses the resistance line twice. The first crossing corresponds approximately to the centre of band A as shown by the curve in FIG. 5D which is simply a portion of the curve shown in FIG. 5C corresponding to frequency band A, whilst the second crossing of the resistance line represents the approximate centre of band B, as shown by the curve of FIG. 5E which is also a portion of the curve shown in FIG. 5C. In this way, the elements of the diplexer perform a good impedance match of the antenna 1 to the filters 36, 38 in both frequency bands A and B, with the reactances of the stub 46 compensating at least partly for the reactances due to the transforming section. Each filter presents a relatively high impedance at the frequency of the other filter, thereby providing isolation between signals in the two bands.

In the example shown in FIG. 1, this isolation is used to isolate a GPS receiver 4 from cellular telephone signals fed to and from a telephone unit 5.

Figure 6:
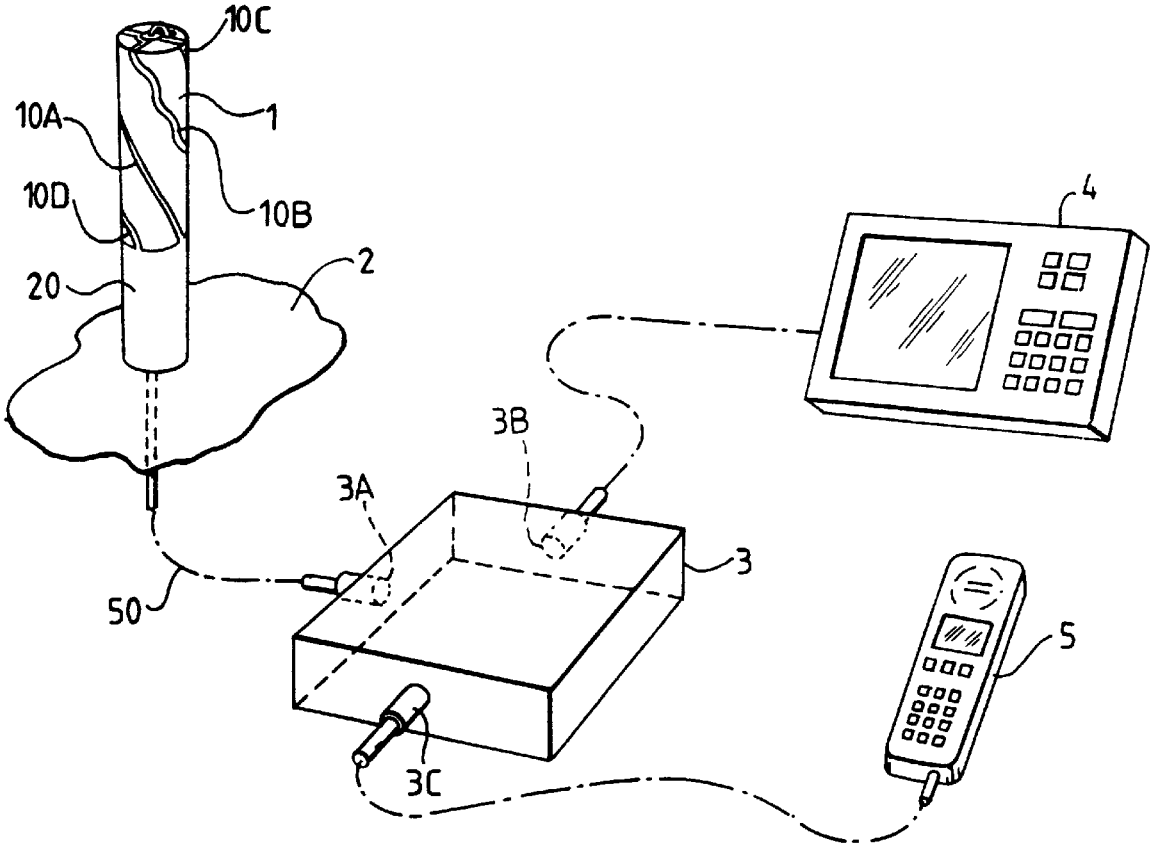
FIG. 6 is a diagram showing a radio communication system using an alternative antenna system in accordance with the invention.

An alternative antenna system is shown in FIG. 6. In this case, the antenna 1 is mounted on a laterally extending conductive surface 2 which, rather than being part of a diplexer casing, instead forms part of another metallic structure, such as a vehicle body. The antenna is coupled through a hole in the surface 2 by means of a feed cable 50 coupled to the common port 3A of a diplexer 3, the latter being similar to the diplexer of the embodiment described above with reference to FIG. 1. Feed cable 3 has an inner conductor coupled to the axial inner conductor of the antenna 1 and an outer shield which is connected to the plated proximal face of the antenna. At the diplexer end of cable 50, the shield is connected to the diplexer casing and directly or indirectly to the ground plane of a microstrip diplexer board within the casing, similar to that show in FIG. 4.

Unless the characteristic impedance of feed cable 50 is the same as the source impedance represented by the antenna 1, the cable 50 acts as an impedance transforming element. The extent to which this occurs depends on the length of the cable and the value of the characteristic impedance, and the microstrip diplexer element is correspondingly altered such that the required total impedance transformation occurring between the antenna 1 and the node 34 of the diplexer (see FIG. 4) has the same effect as the transforming section 32 of the diplexer of the first embodiment described above, and shown in FIGS. 1 and 4. Thus, the electrical length of the combination of cable 50 and the impedance transforming section of the diplexer 3 is about 90° at a frequency approximately midway between the two frequency bands corresponding to the first and second modes of resonance. It is possible, therefore, for the microstrip diplexer to be as shown in FIG. 4 but with impedance transforming section 32 having a much reduced length, or being formed at least in part by a microstrip section having a characteristic impedance equal to the load impedance at load 34. Typically, feed cable 50 has a characteristic impedance of 10 ohms. The system of FIG. 6 uses the alternative antenna mentioned above, in that, while having four helical elements which are generally coextensive and coaxial, two oppositely disposed elements follow meandered paths to achieve the differences in length which bring about the required phase shift conditions for a quadrifilar helix antenna for circularly polarised signals. The meandering of one pair of elements takes the place of the irregular rim of the sleeve 20 shown in FIG. 2, so that in this embodiment sleeve 20 has a circular upper edge which extends around the antenna core at a constant distance from the proximal end.

What is claimed is:

1. An antenna system for radio signals in at least two spaced-apart frequency bands comprising:

an antenna having an elongate dielectric core with a relative dielectric constant greater than 5, at least one pair of elongate conductive elements located in a longitudinally coextensive and laterally opposed relationship on or adjacent an outer surface of a distal part of the core, a conductive sleeve surrounding a proximal part of the core, and a longitudinal feeder structure extending through the core, said elongate conductive elements extending between distal connections to the feeder structure and a distal rim of the sleeve, wherein the antenna is resonant in a first mode of resonance at an upper frequency lying in one of said two frequency bands and in a second mode of resonance at a lower frequency lying in the other of said two frequency bands; and an impedance matching diplexer which has filters coupled between a common port connected to a proximal end of the feeder structure and respective further ports for connection to radio signal processing equipment operating in the two frequency bands, the filters comprising a first filter tuned to the upper frequency, and a second filter tuned to the lower frequency.

2. An antenna system according to claim 1, wherein the first and second modes of resonance are associated respectively with substantially balanced and single-ended feed currents at the distal end of the feeder structure.

3. An antenna system according to claim 1, wherein the first mode of resonance is characterised in operation of the antenna at the upper frequency by current maxima at the connections of the elongate conductive elements to the feeder structure, and at their junctions with the rim of the sleeve, the sleeve acting as a trap which isolates the elongate conductive elements from ground, and wherein the second mode of resonance is characterised in operation of the antenna at the lower frequency by current minima in the region of the junctions of the elongate elements and the rim of the sleeve.

4. An antenna system according to claim 3, wherein the upper frequency is a function of the electrical length of the elongate elements, whilst the lower frequency is a function of the sum of the electrical length of the elongate elements and the electrical length of the sleeve.

5. An antenna system according to claim 4, wherein the average electrical length of the elongate conductive elements is at least approximately 180° at the upper frequency, and the sum of the average electrical length of the elongate conductive elements and the average electrical length of the sleeve in the longitudinal direction of the antenna is at least approximately 180° at the lower frequency.

6. An antenna system according to claim 5, wherein the elongate conductive elements consist of two pairs of helical elements, the elements of each pair being diametrically opposed on the cylindrical outer surface of the core with those of one pair being longer than those of the other pair, whereby the first mode of resonance is a circular polarisation mode associated with circularly polarised signals directed along the central axis of the core, and the second mode of resonance is a linear polarisation mode associated with signals polarised in the direction parallel to the core axis.

7. An antenna system according to claim 1, wherein the core is a solid cylindrical body of ceramic material with an axial bore containing the feeder structure, and wherein the elongate conductive elements are helical.

8. An antenna system according to claim 1, wherein the diplexer comprises an impedance transforming element coupled between the common port and a node to which the filters and an impedance compensation stub are connected.

9. An antenna system according to claim 8, wherein the impedance transforming element, the filters and the stub are formed as microstrip components, the transforming element comprising a conductive strip forming a transmission line of predetermined characteristic impedance, and the stub comprising a conductive strip having an open circuit end.

10. An antenna system according to claim 8, wherein the filters are microstrip bandpass filters connected to the node by conductors which are electrically short in comparison to the electrical length of the transforming element.

11. A radio communication system comprising an antenna system according to claim 1, a satellite signal receiver connected to one of said further ports, and a mobile telephone connected to another of said further ports, the antenna and the filters being configured such that said one of the upper and lower frequencies lies in the operating band of the receiver and said other of the upper and lower frequencies lies in the operating band of the mobile telephone.

12. An antenna comprising:

an elongate core with a relative dielectric constant greater than 5;

at least one pair of elongate conductive elements located in a longitudinally coextensive and laterally opposed relationship on or adjacent an outer surface of a distal part of the core;

a conductive sleeve surrounding a proximal part of the core; and a longitudinal feeder structure extending through the core, said elongate conductive elements extending between distal connections to the feeder structure and a distal rim of the sleeve, wherein the elongate conductive elements are adapted such that the antenna operates in at least two spaced apart frequency bands, one of the bands containing a first frequency at which the antenna exhibits a first mode of resonance and which corresponds substantially to the frequency of signals transmitted in a satellite positioning service, and another of the bands containing a second frequency at which the antenna exhibits a second mode of resonance which is different from the first mode, the frequency of the second resonance corresponding substantially to a frequency used for mobile telephone signals.

13. Use of an antenna according to claim 12, wherein the first and second modes of resonance are associated respectively with a substantially balanced feed current and a single-ended feed current at the distal end of the feeder structure.

14. Use of an antenna according to claim 12, wherein the frequency of the first mode is determined by the electrical lengths of the elongate conductive elements, whereas the frequency of the second mode is determined by the sum of the average electrical length of the elongate conductive elements and the average electrical length of the sleeve.

15. Use of an antenna according to claim 12, wherein the first mode of resonance is associated with circularly polarised signals, whereas the second mode of resonance is associated with signals linearly polarised in the longitudinal direction of the antenna.

16. An antenna system for radio signals in at least two spaced-apart frequency bands comprising:

an antenna having a solid elongate dielectric core, at least one elongate conductive element on or adjacent an outer surface of a distal part of the core, a conductive sleeve surrounding a proximal part of the core, and a longitudinal feeder structure extending through the core, wherein the said elongate conductive element extends between a distal connection to the feeder structure and a distal rim of the sleeve, and the sleeve is proximally coupled to the feeder structure; and wherein the antenna is resonant in a first mode of resonance at an upper frequency lying in one of said two frequency bands and in a second mode of resonance at a lower frequency lying in the other of said two frequency bands; and a coupling stage having a common signal line associated with the feeder structure, at least two further signal lines for connection to radio signal processing equipment operating in the said frequency bands and, connected between the feeder structure and the further signal lines, an impedance matching section and a signal directing section, wherein the signal directing section is arranged to couple together the common signal line and one of the two further signal lines for signals which lie in one of said frequency bands, and to couple together the common signal line and the other of the two further signal lines for signals which lie in the other of said frequency bands.

17. An antenna system according to claim 16, wherein the coupling stage is a diplexer which has filters coupled between the common signal line and the further signal lines, the filters including a first filter associated with one of said two further signal lines and tuned to said upper frequency and a second filter associated with the other of said two further signal lines and tuned to said lower frequency.

18. An antenna system according to claim 17, wherein the diplexer comprises an impedance transforming element coupled between the common signal line and a node to which the filters and an impedance compensation stub are connected.

19. An antenna system according to claim 18, wherein the impedance transforming element, the filters and the stub are formed as microstrip components, the transforming element comprising a conductive strip forming a transmission line of predetermined characteristic impedance, and the stub comprising a conductive strip having an open circuit end.

20. An antenna system according to claim 18, wherein the filters are microstrip bandpass filters connected to the node by conductors which are electrically short in comparison to the electrical length of the transforming element.

21. An antenna system according to claim 16, wherein the antenna has at least one pair of said elongate conductive elements and is adapted such that said elongate conductive element and said sleeve act jointly to define said upper and lower frequencies.

22. An antenna system according to claim 21, wherein at least one of said resonant frequencies is defined by the sum of the length of the sleeve and the length of said elongate conductive element.

23. An antenna system according to claim 16, wherein the sleeve and the feeder structure together act as a balun in at least one of the modes.

24. An antenna system according to claim 16, wherein the first and second modes of resonance are associated respectively with substantially balanced and single-ended feed currents at the distal end of the feeder structure.

25. An antenna system according to claim 16, wherein the dielectric core has an outer surface defining an interior volume at least half of which is occupied by a solid insulative material having a relative dielectric constant greater than 5, the antenna having a least one pair of said elongate conductive elements located in a longitudinally co-extensive and laterally opposed relationship on the outer surface of the distal part of the core each with respective distal connections to the feeder structure and the distal rim of the sleeve, and wherein the common signal line of the coupling stage is coupled to a proximal end of the feeder structure.

26. An antenna system according to claim 25, wherein the first mode of resonance is characterised in operation of the antenna at the upper frequency by current maxima at the connections of the elongate conductive elements to the feeder structure, and at their junctions with the rim of the sleeve, the sleeve acting as a trap which isolates the elongate conductive elements from ground, and wherein the second mode of resonance is characterised in operation of the antenna at the lower frequency by a voltage minimum at or adjacent the coupling of the sleeve to the feeder structure.

27. An antenna system according to claim 26, wherein the upper frequency is a function of the electrical length of the elongate element, whilst the lower frequency is a function of the sum of the electrical length of the elongate element and the electrical length of the sleeve.

28. An antenna system according to claim 27, wherein the average electrical length of the elongate conductive elements is at least approximately 180° at the upper frequency, and the sum of the average electrical length of the elongate conductive elements and the average electrical length of the sleeve in the longitudinal direction of the antenna is at least approximately 180° at the lower frequency.

29. An antenna system according to claim 28, wherein the elongate conductive elements consist of two pairs of helical elements, the elements of each pair being diametrically opposed on the cylindrical outer surface of the core with those of one pair being longer than those of the other pair, whereby the first mode of resonance is a circular polarisation mode associated with circularly polarised signals directed along the central axis of the core, and the second mode of resonance is a linear polarisation mode associated with signals polarised in the direction parallel to the core axis.

30. An antenna system according to claim 16, wherein said at least one elongate conductive element and the sleeve, together with the core, constitute a unitary structure having a plurality of different modes of resonance which are characterised by standing wave maxima and minima of differing patterns within the unitary structure.

31. An antenna system according to claim 30, wherein each of said patterns of standing wave maxima and minima exist on the outer surface of the core between the distal connection of the at least one elongate conductive element to the feeder structure and proximal coupling of the sleeve to the feeder structure.

32. An antenna system according to claim 16, wherein the core is a solid cylindrical body of ceramic material with an axial bore containing the feeder structure, and wherein the elongate conductive elements are helical.

33. A radio communication system comprising an antenna system according to claim 16, wherein the antenna system has a pluarity of ports a satellite positioning or timing receiver connected to one of the said ports, and cellular or mobile telephone circuitry connected to another of said ports, the antenna and the filters being configured such that the one of the upper and lower frequencies lies in the operating band of the receiver and the other of the upper and lower frequencies lies in the operating band of the mobile telephone circuitry.

34. A radio communication apparatus comprising an antenna and, connected to the antenna, radio communication circuit means operable in at least two radio frequency bands, wherein the antenna comprises an elongate dielectric core, a feeder structure which passes through the core substantially from one end to the other end of the core, and, located on or adjacent the outer surface of the core, the series combination of at least one elongate conductive antenna element and a conductive trap element which has a grounding connection to the feeder structure in the region of the said one end of the core, the or each antenna element being coupled to a feed connection of the feeder structure in the region of the said other end of the core, and wherein the radio communication circuit means have two parts operable respectively in a first and a second of the radio frequency bands and each associated with respective signal lines for conveying signals between the antenna feeder structure and the respective circuit means part, the antenna being resonant in a first resonance mode in the first frequency band and in a second resonance mode in the second frequency band.

35. An apparatus according to claim 34, wherein the first and second modes of resonance are associated respectively with substantially balanced and single-ended feed currents at the feed connection.

36. An apparatus according to claim 34, wherein the conductive elements of the series combination, and the dielectric core, constitute a unitary structure having a plurality of different modes of resonance which are characterised by standing wave maxima and minima of differing patterns within the unitary structure.

37. An apparatus according to claim 36, wherein the antenna is formed without lumped filtering components dividing the antenna into separately resonant parts, and wherein all conduction paths of the unitary structure are available to currents at all frequencies, the resonant paths at each resonant frequency being the preferred paths at that frequency.

38. An apparatus according to claim 34, wherein the core is a rod of solid dielectric material having a relative dielectric constant greater than 5, and wherein the said series combination comprises at least one pair of longitudinally coextensive elongate antenna elements and the trap element is a conductive sleeve encircling the rod on the surface of the rod.

39. An antenna comprising:

an elongate core with a relative dielectric constant greater than 5;

at least one pair of elongate conductive elements located in a longitudinally coextensive and laterally opposed relationship on or adjacent an outer surface of a distal part of the core;

a conductive sleeve surrounding a proximal part of the core; a longitudinal feeder structure extending through the core, said elongate conductive elements extending between distal connections to the feeder structure and a distal rim of the sleeve;

wherein the elongate conductive elements are adapted such that the antenna operates in at least two spaced apart frequency bands, one of the bands containing a first frequency at which the antenna exhibits a first mode of resonance, said first frequency being 1.575 GHz, and another of the bands containing a second frequency at which the antenna exhibits a second mode of resonance which is different from the first mode, said second frequency being in the band of from 800 to 900 MHz.

* * * * *